United States Patent [19]

Bussey, Jr.

[11] 4,166,875

[45] Sep. 4, 1979

[54] FREE-FLOWING PACKAGING MATERIAL

[76] Inventor: Harry Bussey, Jr., P.O. Box 115, Serpentine Dr., Navesink, N.J. 07752

[21] Appl. No.: 840,293

[22] Filed: Oct. 7, 1977

[51] Int. Cl.[2] ..... B32B 3/00

[52] U.S. Cl. ..... 428/159; 206/523; 206/584; 206/814; 428/156; 428/179; 428/402; 428/542

[58] Field of Search ..... 428/159, 160, 332, 358, 428/402, 542, 156, 179; 206/54, 523, 584; 264/51; 260/25 E; 261/DIG. 72; 93/1 WZ

[56] References Cited

U.S. PATENT DOCUMENTS

| | | | |
|---|---|---|---|
| 3,896,934 | 7/1975 | Graham et al. | 206/523 |
| 4,027,064 | 5/1977 | Bussey, Jr. | 206/523 |
| 4,042,658 | 8/1977 | Collins | 428/402 |

*Primary Examiner*—Stanley S. Silverman
*Attorney, Agent, or Firm*—Kenyon & Kenyon

[57] ABSTRACT

The loose fill packaging material of the illustrated embodiment comprises a plurality of free-flowing elements of, for example, expanded polystyrene. Each packaging element of the embodiment is of a block-like E-shaped form which includes three leg portions which define a pair of recesses between the legs. The width of the recesses is less than the width of the leg portions and, in use, the leg portions of one element do not fit within the recesses of another element. Instead, the packaging elements abut one another, rather than interlock, while forming a mass of resilient packaging material about an item packaged therewithin.

13 Claims, 10 Drawing Figures

Fig. 1.
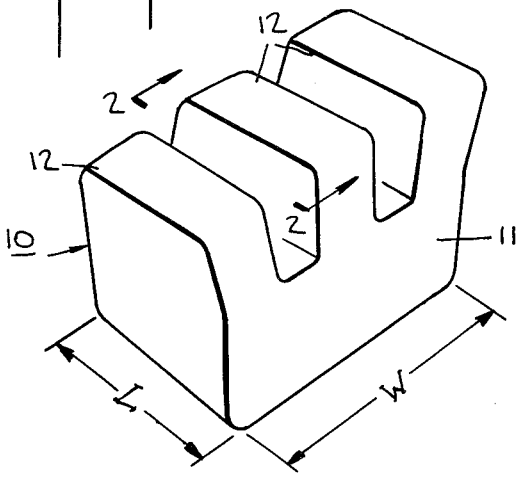
Fig. 8.
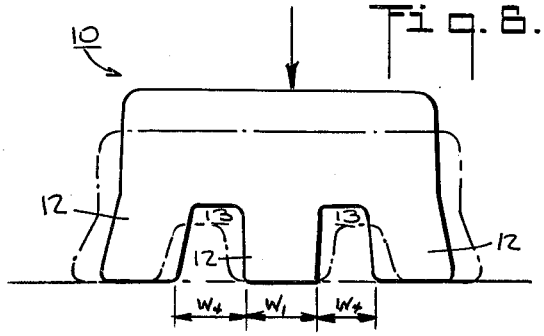
Fig. 5.
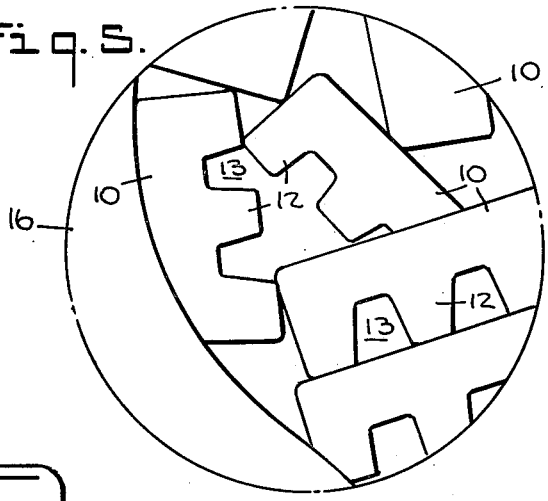
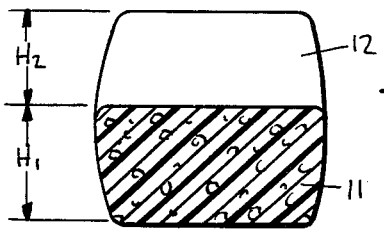
Fig. 2.
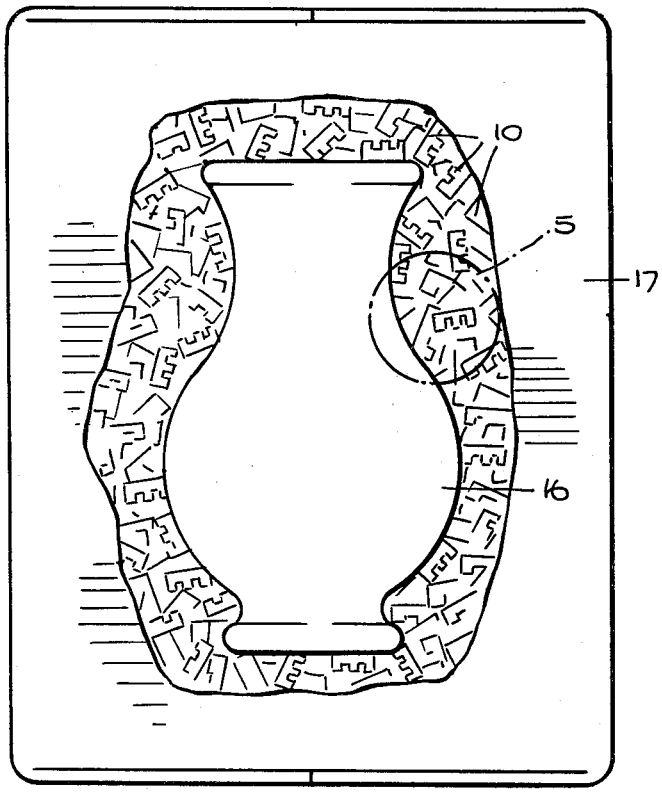
Fig. 4.
Fig. 3.
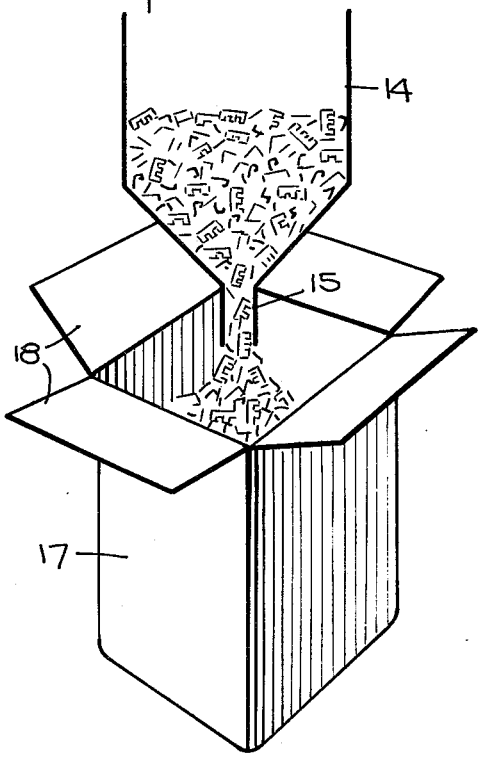

FREE-FLOWING PACKAGING MATERIAL

This invention relates to a packaging material and, more particularly, to a loose fill packaging material comprised of elements which may free-flow with respect to one another rather than interlock.

Various types of loose fill packaging materials have heretofore been known. For example, U.S. Pat. No. 4,027,064 describes materials made of expandable or expanded thermoplastic material and formed with various shapes. Also, U.S. Pat. No. 3,074,543 describes elements made in the form of small collapsible cylinders; U.S. Pat. No. 3,188,264 describes elements with an elongated H-shape or Y-shape cross-section; and U.S. Pat. No. 3,251,728 describes elements with various random shapes.

Loose fill packaging materials are generally intended to provide a cushion to protect an item being transported in a shipping container against severe impacts or strong vibrations. During the transport of an item so cushioned, the loose fill packaging elements may at times tend to migrate within the shipping carton or other container to such an extent that the packaged item shifts to one side of the carton, and becomes subject to damage on that relatively unprotected side. In order to overcome that problem, loose fill packing elements have heretofore been made with shapes which permit the packing elements to interlock with one another when the elements are in place within the shipping container. However, a problem has arisen with respect to the flowability of such interlocking elements when the elements are being inserted into or removed from a shipping carton. Thus, where their shape or variety of shapes permits the elements to interlock within the shipping carton, interlocking may also occur in the supply hopper employed to fill the shipping carton. In such an event, the elements may either fall from the supply hopper in interlocked batches which overfill the carton or inadequately fill the space provided for packaging within the carton, or the elements may become dammed at the mouth of the supply hopper and not fall into the carton at all. In such circumstances, time and labor must be expended to manually unblock the hopper to permit a flow of elements into the carton, manually remove the over-fill from the shipping carton or manually adjust the elements within the carton.

Loose fill packaging elements which interlock with one another are also not as readily removed as free-flowing packaging elements when unpacking the carton upon its delivery. Further, elements which interlock may also settle when they are within a carton if moved about within the carton as they may then interlock differently and occupy a different volume.

Packaging elements have heretofore been known which are free-flowing instead of interlocking in nature. For example, previously mentioned U.S. Pat. No. 4,027,064 describes packaging elements of a generally block C-shape which allows the elements to be readily flowable when being dumped into a shipping carton, while also allowing the elements to effect a nesting relationship when the packaging elements are in place about an item being packaged in a shipping carton. Such nesting serves to deter migration of the item being packaged in a shipping container to a side of the container. However, such nesting of the packaging elements also tends to reduce the total volume of voidage in the mass of packaging material about the packaged item, whereas a relatively large voidage is frequently desirable to reduce the cost of the packaging, the overall weight of the packed carton and the cost of shipment of the packed carton.

Accordingly, it is an object of the invention to provide a loose fill packaging material which is free-flowing upon both insertion into and removal from a shipping container, and which also provides a relatively large voidage within a shipping carton when the packaging material is in use.

It is another object of the invention to reduce the shipping weight of a carton containing an item packed in a resilient packaging material.

It is another object of the invention to provide a loose fill packaging material which is capable of efficiently cushioning an item within a shipping carton.

It is another object of the invention to provide a packaging material element of relatively simple construction which can be manufactured in a relatively easy manner.

Briefly, the invention provides a loose fill packaging material which is comprised of a plurality of resilient elements each of which has a body portion and three leg portions extending from the body portion. The leg portions of each element define recesses in the element, and each of the leg portions has a width which is greater than the corresponding width of a recess.

The shape of the packaging element and the relative sizes of their leg portions and recesses are such that the leg portions of one element cannot fit into the recesses of another element in an interlocking relation. This characteristic allows the elements to be both readily poured into and removed from a shipping carton and also to take on a random relationship with respect to each other, without interlocking, when in a shipping carton. As a result, the packaging mass formed by the elements when they are in a shipping carton has a relatively high voidage or porosity, that is, a relatively large amount of air space is contained within the mass of elements.

When the packaging elements form a packaging mass within a shipping carton, the bulk provided by the body and leg portions of the packaging elements provides a cushion to absorb vibration and impact forces imposed on the shipping carton. Also, the recesses and the corners of the body and leg portions of the packaging elements abut and interrelate, without interlocking, to provide a relatively stable mass of packaging material within the shipping carton.

In a described embodiment of the invention, the packaging elements of the invention each have a block-like E-shaped form wherein one side of the element has a discontinuous surface which extends about the faces of the base and leg portions of the element which define the recesses, and across the distal faces of the leg portions. Each other side surface of the element has a planar or curved surface which is substantially continuous, for example except for imperfections or dips in the surface resulting from the expansion by heating of a latent foaming element. The substantially continuous nature of all but one of the side surfaces of the packaging elements augments their free-flowing characteristic upon being poured into or removed from a shipping carton.

The packaging material can be made of any suitable resilient material. For example, the packaging material can be made of a resilient thermoplastic material selected from the group consisting of polystyrene, polyethylene, polypropylene and polyurethane. Further, when made of a thermoplastic material, the packaging material can be supplied to a user in either an expandable state or in an expanded state. In the former case, the user may expand the packaging elements to an expanded state when the elements are to be used.

These and other objects and advantages of the invention will become more apparent from the following detailed description and appended claims taken in conjunction with the accompanying drawings in which:

FIG. 1 illustrates a perspective view of a packaging element according to the invention;

FIG. 2 illustrates a view taken on line 2—2 of FIG. 1;

FIG. 3 illustrates a cross-sectional view of a supply hopper discharging packaging material of the invention into a shipping carton;

FIG. 4 illustrates a partly sectional view of a shipping carton containing a vase packed with packaging material of the invention;

FIG. 5 illustrates an exploded detail view taken within circle 5 of FIG. 4;

FIG. 6 illustrates a schematic view of the manner in which a packaging element resists a compressive force in accordance with the invention;

Figure 7:
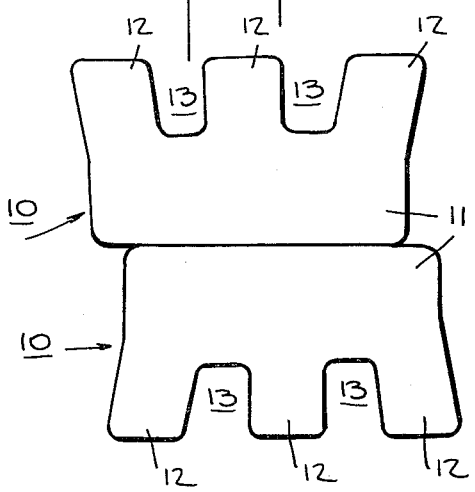
FIG. 7 illustrates a possible arrangement of a pair of packaging elements of the invention within a shipping carton.

Referring to FIG. 1, each packaging element 10 of the illustrated embodiment of the invention is of a block-like E-shape form with a body portion 11 and three leg portions 12 which extend integrally from the body portion 11. Both the body portion 11 and the leg portion 12 have a substantially rectangular cross-sectional shape with slightly rounded peripheral contours as shown in FIG. 2. As indicated in FIG. 2, the height $H_1$ of the body portion 11 of the packaging element 10 is substantially equal to the height $h_2$ of each leg portion 12. That is, the leg portions 12 extend substantially equally from the body portion 11 a distance substantially equal to the height or thickness of the body portion 11.

Referring to FIGS. 1 and 6, the leg portions 12 of each packaging element 10 define two recesses 13 between the leg portions 12 which are of a width $W_4$ less than the corresponding width $W_1$ of the leg portions 12. Thus, each element 12 has a side width a discontinuous surface which defines the recesses 13 and extends across the faces of the leg portions 12 which are farthest from the body portion 11, while the opposite side surface is continuous.

Referring to FIG. 1, each packaging element 10 has a body portion length L along its axis of extrusion (see FIG. 9) of about $\frac{3}{4}$ inch, and a body portion width W of about $1\frac{3}{8}$ inches. The two outermost leg portions 12 are flared outwardly at their distal ends, with the span or width between the outermost surfaces of the distal ends of the two outermost leg portions being about $1\frac{5}{8}$ inches.

The packaging elements 10 are made of any suitable resilient material, for example of an extruded foamed thermoplastic material such as polystyrene, polyethylene, polypropylene or polyurethane. The elements may be provided in an expandable state or an expanded state, as is known.

Referring to FIG. 3, in use, a supply of packaging elements 10 is stored within a hopper 14 having, for example, a mouth 15 of reduced size. In order to package an item 16 (see FIG. 4) in a carton 17 having end flaps 18, the carton 17 is initially disposed beneath the hopper 14 in an open condition. The packaging material is then dispensed from the hopper 14 through the mouth 15 of the hopper to form a layer of packaging material on the bottom of the carton 17. The item 16 to be packaged is then placed on this layer within the carton 17 and packaging material is again discharged from the mouth 15 of the hopper to fill the remainder of the carton 17. The carton 17 is filled to a slight overflowed state so that when the end flaps 18 of the carton are folded over into a closed condition, the packaging material 10 is placed under a slight compressive load within the carton 17. This serves to enhance the fixation of the item 16 within the carton 17.

Referring to FIG. 5, the free-flow manner of filling of the carton 17 with the packaging material allows the packaging elements 10 to take on a random relationship with respect to each other. In this regard, as shown in FIG. 5, the corners of one packaging element 10 may abut a recess 13 of another element 10, or one surface of a packaging element 10 may be abutted against a surface of another packaging element 10. In any event, the leg portions 12 of one element 10 cannot fit into a recess of another element 10 in an interlocking relation. The abutting interrelationship of the elements 10 provides a relatively stable mass to deter migration of the packaged item 16 within the carton 17.

Figure 8:
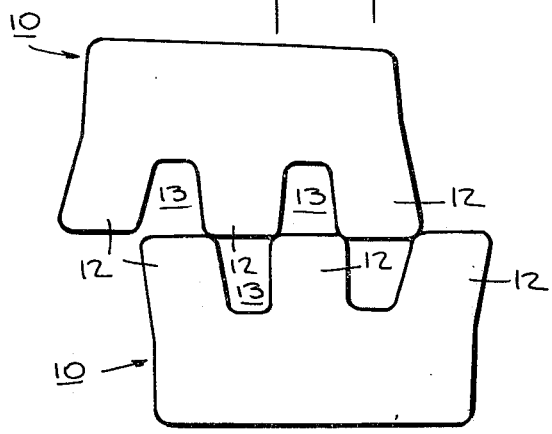
FIG. 8 illustrates another possible relationship of a pair of packaging elements of the invention within a shipping carton.

It is to be emphasized that the relationship between the leg portions 12 and the recesses 13 of the packaging elements 10 is such as to prevent an interlocking engagement between any two elements 10. For example, as shown in FIG. 7, two elements may be disposed in back-to-back relationship. In this relationship, the elements 10 may slide one with respect to the other on their respectively confronting continuous surfaces. If two elements 10 are disposed as shown in FIG. 8 with their leg portions 12 in facing relation (i.e. with their respectively discontinuous surfaces in contact), the leg portions 12 of one element do not fit into the recesses 13 of the opposed element 10 but rather form bridges across the recesses 13. Thus, the elements 10 remain free-flowing and do not interlock or become tangled with respect to each other. To this end, it is also noted that a packed shipping carton can be emptied simply by opening the flaps 18 and by pouring out the elements 10, which can be accomplished by mechanical means (not shown) instead of by manual removal of the elements 10 and the packaged item 16.

Referring to FIG. 6, should a force F be imposed, for example, upon the body portion 11 of a packaging element 10, the element 10 will compress in a resilient manner as indicated in dotted line. In this circumstance, the leg portions 12 of the element 10 deform and slightly reduce the size of the recesses 13.

Figure 10:
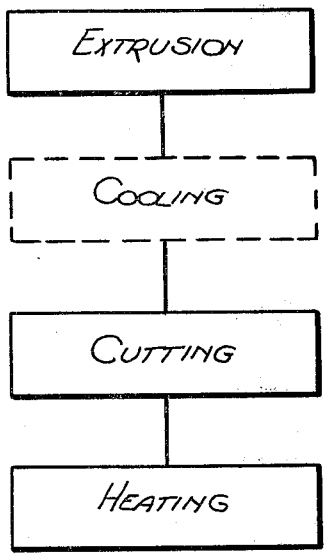
FIG. 10 illustrates a flow diagram of a method of making packaging material of the invention.
Figure 9:
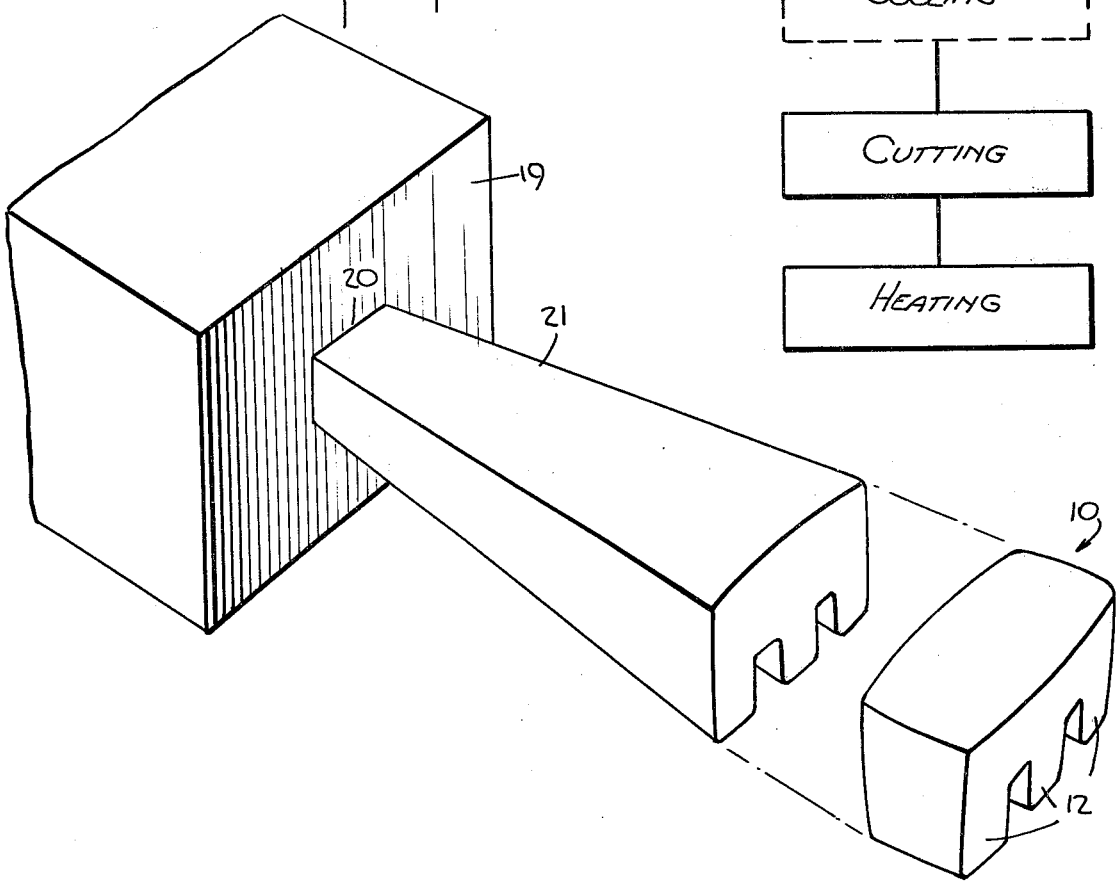
FIG. 9 illustrates a perspective view of an extruder during extrusion of a bar-like form from which packaging material of the invention is made.

Referring to FIGS. 9 and 10, to make the packaging elements 10 of this invention, the process used may be generally any one of those as described in, for example, U.S. Pat. Nos. 3,074,543 and 3,188,264. A mass of granular particles of a suitable thermoplastic material is placed in an extruder together with a hydrocarbon blowing or expanding agent as is known. An extrudate is then formed which is extruded through a die 19 having an E-shaped outlet 20 to produce a bar-like form 21 of E-shaped cross-section. The bar-like form 21 is cut transversely of the longitudinal axis of extrusion at intervals along the extruded length into small pieces by any suitable cutting means (not shown) to form the individual discrete elements 10.

By the heretofore known processes, the packaging elements 10 may be fully expanded at the time of the extrusion and cutting, or the elements may be provided in a latent-foaming or expandable state following the extrusion. Referring to FIG. 10, the elements 10 may also be formed by a process in which the extruded bar-like material is cooled in a partially expanded state, as is known, the elements are then severed from the bar-like form, and the severed elements are subsequently further expanded by heat as is known at the place where the elements 10 are to be actually used for packaging.

Referring to FIGS. 4 and 5, it is noted that when the packaging elements 10 are in place within a shipping carton 17, the elements 10 due to their configuration permit relatively large voids or air spaces to be formed not only by the recesses 13 of the packaging elements themselves, but also between the respective elements (see FIG. 5). This reduces the number of elements 10 required to package an item and, in turn, reduces the overall weight of the packaging material required and the weight of the shipping carton.

The invention thus provides a packaging material composed of packaging elements which permit ready filling and emptying of a carton, create an abutting relationship when packed in a carton so as to deter migration of a packaged item and also provide a relatively large voidage within a shipping carton so as to reduce the overall weight of material required to package an item. Further, because of their shape, the E-shaped elements will not settle in a carton if moved. That is, no matter how the elements fall into place, they will not take up more or less space for there is no nesting or interlocking.

It is noted that apart from the dimensions given above, the size of the elements depends on the weight, dimensions and configuration of the article to be packaged as well as the positioning of the article in the package. Thus, the dimensions may vary over a wide range. What is claimed is:

1. A loose fill packaging material comprising a plurality of expanded resilient thermoplastic elements, each said element having a body portion and three leg portions which extend substantially from said body portion and define recesses between said leg portions, wherein each said leg portion has a width which is greater than the corresponding width of a recess.

2. A packaging material as set forth in claim 1 wherein each said element has a side with a discontinuous surface which defines the recesses and extends across the faces of said leg portions which are farthest from said body portion, and wherein each other side surface of said element is substantially continuous.

3. A packaging material as set forth in claim 1 wherein each said element has a block-like E-shaped form.

4. A packaging material as set forth in claim 1 wherein said elements are made of expanded polystyrene.

5. A loose fill packaging element of expanded resilient thermoplastic material, said element having a body portion and three leg portions which extend substantially from said body portion and define recesses therebetween, wherein each said leg portion has a width which is greater than the corresponding width of a recess.

6. A loose fill packaging element as set forth in claim 5 wherein said element has a side with a discontinuous surface which defines the recesses and extends across the faces of said leg portions which are farthest from said body portion, and wherein each other side surface of said element is substantially continuous.

7. A loose fill packaging element as set forth in claim 5 having a block-like E-shaped form.

8. A loose fill packaging element as set forth in claim 6 wherein said body portion and said leg portions are such of generally rectangular cross-section.

9. A loose fill packaging element as set forth in claim 6 wherein the outermost leg portions each have a surface which is flared outwardly relative to said body portion.

10. A loose fill packaging material comprising a plurality of expandable resilient thermoplastic elements, each said element having a body portion and three leg portions which extend substantially from said body portion and define recesses between said leg portions, wherein each said leg portion has a width which is greater than the corresponding width of a recess.

11. A packaging material as set forth in claim 10 wherein each said element has a block-like E-shaped form.

12. A loose fill packaging element of expandable resilient thermoplastic material, said element having a body portion and three leg portions which extend from said body portion and define recesses therebetween, wherein each said leg portion has a width which is greater than the corresponding width of a recess.

13. A loose fill packaging material comprising a plurality of resilient expanded thermoplastic elements, each said element being of block-like E-shaped form having a body portion of substantially rectangular cross-sectonal shape and three leg portions of substantially rectangular shape which extend from said body portion and define recesses between said leg portions, wherein each said leg portion has a width which is greater than the corresponding width of a recess.

* * * * *